United States Patent [19]

Djurinec

[11] 4,130,333

[45] Dec. 19, 1978

[54] QUICK CONNECT ELECTRICAL PLUG

[75] Inventor: Marijan Djurinec, Acton, Canada

[73] Assignee: Smith & Stone Limited, Toronto, Canada

[21] Appl. No.: 884,350

[22] Filed: Mar. 6, 1978

[30] Foreign Application Priority Data

Nov. 15, 1977 [CA] Canada ..... 290952

[51] Int. Cl.[2] ..... H01R 13/38

[52] U.S. Cl. ..... 339/97 P

[58] Field of Search ..... 339/97 R, 97 P, 99 R

[56] References Cited

U.S. PATENT DOCUMENTS

| | | | |
|---|---|---|---|
| 2,647,245 | 7/1953 | Gilbert | 339/99 R |
| 2,682,647 | 6/1954 | Smith | 339/99 R |
| 2,888,659 | 5/1959 | Gilbert | 339/99 R |

*Primary Examiner*—Joseph H. McGlynn

*Attorney, Agent, or Firm*—Beveridge, DeGrandi, Kline & Lunsford

[57] ABSTRACT

A quick-connect electrical plug using insulation-piercing spikes formed on the inner ends of terminal members. The same inner ends also have a cable gripping region which enhances the mechanical retention of a lamp-cord in the plug so that the cord will withstand a pull of 20 lbs. minimum. The plug and its associated terminals are so configured that the electrical-cord and the terminals connot be removed once the cord has been assembled to the plug.

1 Claim, 1 Drawing Figure

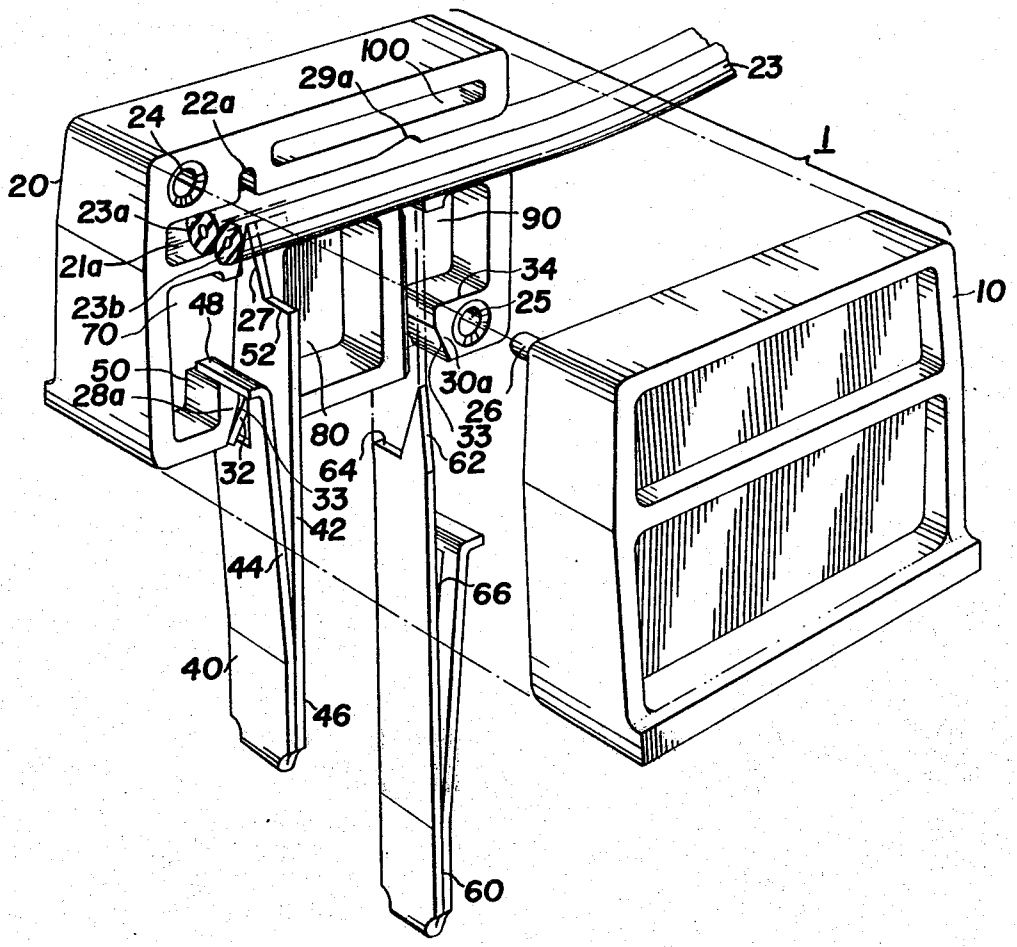
10
1
23
90
34
25
26
30a
33
62
66
60
100
29a
80
64
33
42
46
22a
27
52
32
44
24
48
40
23a
21a
23b
70
50
28a
20

QUICK CONNECT ELECTRICAL PLUG

This invention relates to quick-connect electrical plugs primarily, but not exclusively, for use with lamp-cord, known in trade as POT 64 or 190 18 AWG SPT-1 wire.

It is to be understood that the term "Quick-Connect" refers to electrical devices wherein cables and wires for use herewith are electrically connected to the terminal members thereof without the use of strippers or any other tool.

Quick-connect plugs are typified by the following U.S. Pat. Nos. 2,475,243 July 5, 1949 (IRRGANG); 2,647,247 July 28, 1953 (Gilbert); 2,673,968 Mar. 30, 1954 (Smith); 2,678,429 (Abbott); 2,682,647 June 29, 1954 (Smith); 2,787,772 Apr. 2, 1957 (Liaci) and 2,888,659 May 26, 1959 (Gilbert).

It will be shown that the present invention provides a quick-connect plug which bears no comparison with prior art since the structural differences are very numerous and the method of operation quite unalike. Such a novel approach has been made necessary in order to reduce costs and meet the requirements of the Canadian Standards Association and Underwriters Labratories, Inc.

The invention was conceived in order to overcome the primary deficiency of prior art quick-connect plugs. One of the requirements of the Canadian Standards Association stipulates that the cord or cable must mechanically resist a pull of 20 lbs. and must make a reliable electrical connection.

Comparison testing carried out by applicant indicates that the present invention provides a plug which gives a more reliable connection than other Quick-Connect plugs evaluated. From a user viewpoint this may be the most important feature. The invention provides a quick-connect plug which is formed of two havles which may be ultrasonically or otherwise welded together or fastened together by some other mechanical means such as rivets, eyelets or screws which cannot be separated after such joining without complete destruction of the plug unless a screw fastener is used. Similarly, since a cord has been electrically and mechanically joined to the terminals the cord cannot be separated therefrom without destruction of the plug, unless again the two halves are held together by means of a mechanical fastener.

It is an object of one feature of the invention to provide a quick-connect plug which cannot be disconnected from an electrical cord when once connected to that cord.

It is an object of another feature of the invention to provide a quick-connect plug which retains an electrical cord therein with a strength equal to or greater than the minimum value stipulated by the Canadian Standards Association and Underwriters Labratories Inc.

In accordance with foregoing objects, there is provided a quick-connect electrical plug for use with a two-conductor insulated cord said plug comprising:

(A) first and second housing members, said housing members having groups of associated and opposed apertures paired recesses and cavities to form;

(a) a cord receiving slot, terminating at an outer surface of said plug;

(b) first and second terminal receiving slots each disposed substantially perpendicularly to said cord receiving slot, said slots terminating at an outer surface of said plug;

(c) first and second terminal retainer means within the interior of housing members, each retainer means being disposed adjacent to an associated one of said terminal receiving slots;

(d) a spike-receiving recess in said cord receiving slot in said first housing disposed in line with the first of said terminal receiving slots and a spike-receiving recess in said cord receiving slot in said second housing disposed in line with said second terminal receiving slot;

(e) a wedge-shaped recess in said cord receiving slot in said first housing disposed in line with said second terminal receiving slot and a wedge-shaped recess in said cord receiving slot in said second housing disposed in line with said first terminal receiving slot, and (B) first and second terminals for slidable reception in said first and second terminal receiving slots, each of said terminal comprising:

(i) a short tine and a line tine joined together at adjacent ends thereof, said adjacent ends constituting a blade for insertion into a receptacle, said tines being urged apart at the opposite ends thereof by the inherent springiness of the material of which the contacts are made, the longer of said tines terminating with a first spike at said opposite end thereof, said spike being positioned to penetrate the insulation and conductor of one of said conductors in said cord and to enter said spike receiving recess, said longer tine also including a cable clamping portion adjacent said spike, said cable clamping portion being positioned to abut the insulation around the said conductors and to deform said conductor into said associated wedge-shape recess, the shorter of said tines having an ear formed thereon, said ear abutting said terminal retaining means when the associated said terminal is slid outwardly of said housing members, the said short tine further including a resilient detent, said detent snapping behind said terminal retaining means when the said terminal is slid into insulation and conductor piercing relationship with the said cord, the said first and second terminals being permanently locked in position after insertion of said first and second terminals.

The invention will be described with reference to the accompanying drawing which is an exploded isometric view and which also shows a portion of an associated electrical cord.

The connector, generally indicated at 1, is formed of two parts, namely, a first housing 10 and a second housing 20. The inside cavities and recesses in one half are mirror-imaged with respect to the other half with a few exceptions as which will be discussed. Those elements which are common to both halves will be discussed firstly. A cord receiving slot 21 is formed of a first slot **21*a* and second slot 21*b* (not shown). The height and depth of both the slits 21*a* and 21*b* are about equal to the outer diameter of the insulation of Lamp Cord (known in the trade at POT 64 or SPT-1), a portion of which cord is indicated at 23. The depth of slot generally will be about 0.115 inches. The slots 21*a* and 21*b*** are open to the exterior at one end thereof and closed at the opposite end thereof.

The second half 20 of the housing includes a pair of chamfered blind holes 24 and 25 to receive, upon assembly, spigots, one of which is indicated at 26 and which protrude from the first half 10 of the housing. A pair of terminal receiving apertures 28*a* and 30*a* are disposed in the bottom of the second half 20 and it is to be understood that the apertures 28*a* and 30*a* are formed opposite to associated apertures 28*b* and 30*b* (not shown) in the first half 10. Apertures 28*a* and 28*b* together serve, upon assembly, to receive a first terminal 40 and aperture 30*a* and 30*b* together serve to receive a second terminal 60. The two halves of the plug, 10 and 20, are formed from a suitable moldable and electrically insulative material. The first terminal 40 is composed of a longer tine 42 and shorter tine 44, the two tines being urged apart by the inherent resiliency of the contact material. Each of the two tines is formed into a blade portion 46 for reception in a receptacle. The terminals may be formed of a suitable contact material which has adequate springiness and hard yellow brass is found excellent. The short tine 44 has an outwardly bent travel restricting ear 48 which, in the manufactured and unassembled condition of the plug, abuts a shoulder 50 formed in the interior of the first half 20. A spike 27, formed at the top of the terminal 40, is positioned to penetrate the insulation of the one side 23*a* of the cord 23 and to make electrical contact with the wire therein when the terminal is pushed upwardly. In order to ensure that the spike can fully penetrate the wire an internal recess 22*a* is provided in the plane of the terminal 40. When the terminal has fully penetrated the cord 23*a* a flat portion 52 embeds itself into the cord 23*b* opposite a wedge-shaped recess 29*b*, not shown, in the first half 10 but of similar shape to a recess 29*a* shown in the second half 20.

The shorter tine 44 is provided with a downwardly extending and outwardly urged detent 32. The detent 32 serves to hold the spike 27 into the cord 23*a* by abutting the same shoulder 50 which served to retain travel restricting ear 48.

The second terminal 60 is actually identical, but installed in a reverse manner, to the first terminal 40 and during connection to an electrical cord its spike 62 penetrates the cord 23*b*, and its flat portion 64 embeds itself into cord 23*a*. A detent 66 maintains the spike in the cord 23*b*, by abutting a shoulder 34 after assembly.

In order to facilitate insertion of the terminals 40 and 60 into their respective apertures in the two halves 10 and 20 of the connector 1, chamfers 33 may be included.

In order to prevent inadvertent and premature movement of the tines into the locked position prior to insertion of a cord, an elongated dummy insert, of about the same cross-sectional shape as the cord, could be inserted into the slots 21. In practice the outward spring pressure of the terminals especially 32 and 66 provides friction which prevents the terminals from moving toward the receiving slots.

It is to be understood that the plug is shipped with two halves 10 and 20 ultrasonically, or by other means, welded or fastened together. The outer major surfaces of the two halves 10 and 20 may be suitably configured to facilitate manual withdrawal of the plug from a receptacle, and to conserve material. Similarly internal spaces such as at 70, 80, 90 and 100 may be provided.

It is to be understood that the positions of the recess 22*a* and the wedge-shaped recess 29*a* on the first half 20 are reversed on the second half 10. Therefore, there is a recess, similar to that shown at 22*a*, 22*b* and wedge-shaped recess, similar to that shown at 29*a*, 29*b* for each spiked end of each terminal.

The terminals may be solid with retaining tines 32 and 66 pierced out of a solid blade. In which case ear 48 may be formed from same blade by notching one edge and bending a piece over.

The quick-connect plug described in the foregoing provides positive electrical connection, is fast to assemble, is difficult if not impossible to take apart, is relatively inexpensive to manufacture, meets the Canadian Standards Association and Underwriters Labartories Inc. 20 lbs. pull test requirement and is suitable for use at a line voltage of 125 and rated 15 amperes to the ampere capacity of the cord.

Other embodiments falling within the terms of the appended claims will occur to those skilled in the art.

I claim:

1. A quick-connect electrical plug for use with a two-conductor insulated cord said plug comprising:

(A) first and second housing members, said housing members having groups of associated and opposed apertures, paired recesses and cavities to form an assembly;

(a) a cord receiving slot, terminating at an outer surface of said plug;

(b) first and second terminal receiving slots each disposed substantially perpendicularly to said cord receiving slot, said terminal receiving slots terminating at an outer surface of said plug;

(c) first and second terminal retainer means within the interior of housing members, each retainer means being disposed adjacent to an associated one of said terminal receiving slots;

(d) a spike-receiving recess in said cord receiving slot in said first housing disposed in line with the first of said terminal receiving slots and a spike-receiving recess in said cord receiving slot in said second housing disposed in line with said second terminal receiving slot;

(e) a wedged-shaped recess in said cord receiving slot in said first housing disposed in line with said second terminal receiving slot and a wedge-shaped recess in said cord receiving slot in said second housing disposed in line with said first terminal receiving slot, and (B) first and second terminals for slideable reception in said first and second terminal receiving slots, each of said terminals comprising:

(i) a short tine and a long tine joined together at adjacent ends thereof, said adjacent ends constituting a blade for insertion into a receptacle, said tines being urged apart at the opposite ends thereof by the inherent springiness of the material of which the contacts are made, the longer of said tines terminating with a first spike at said opposite end thereof, said spike being positioned to penetrate the insulation and conductor of one of said conductors in said cord and to enter said spike receiving recess, said longer tine also including a cable clamping portion adjacent said spike, said cable clamping portion being positioned to abut the insulation around the other of said conductors, and to deform said conductor into said associated wedge-shape recess, the shorter of said tines having an ear formed thereon, said ear abutting said terminal retaining means when the associated said terminal is slid outwardly of said housing members, the said short tine further including a resilient detent, said detent snapping behind said terminal retaining means when the said terminal is slid into insulation and conductor piercing relationship with the said cord, the said first and second terminals being permanently locked into the said first and second housing members after insertion of said first and second terminals.

* * * * *